US010601142B2

(12) United States Patent
Henderson et al.

(10) Patent No.: US 10,601,142 B2
(45) Date of Patent: Mar. 24, 2020

(54) REFLECTING SYSTEMS, SUCH AS REFLECTOR ANTENNA SYSTEMS, WITH TENSION-STABILIZED REFLECTOR POSITIONING APPARATUS

(71) Applicant: Eagle Technology, LLC, Melbourne, FL (US)

(72) Inventors: Philip J. Henderson, Palm Bay, FL (US); Timothy L. Fetterman, Palm Bay, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 0 days.

(21) Appl. No.: 16/037,954

(22) Filed: Jul. 17, 2018

(65) Prior Publication Data

US 2020/0028274 A1 Jan. 23, 2020

(51) Int. Cl.

| | |
|---|---|
| ***H01Q 19/18*** | (2006.01) |
| ***H01Q 15/14*** | (2006.01) |
| ***H01Q 15/16*** | (2006.01) |

(52) U.S. Cl.

CPC ..... *H01Q 19/18* (2013.01); *H01Q 15/14* (2013.01); *H01Q 15/16* (2013.01)

(58) Field of Classification Search

CPC ..... H01Q 19/18; H01Q 15/14; H01Q 15/16; H01Q 15/161

See application file for complete search history.

(56) References Cited

U.S. PATENT DOCUMENTS

| | | | | |
|---|---|---|---|---|
| 3,120,831 | A | 2/1964 | Fulton | |
| 3,553,731 | A * | 1/1971 | Szirtes | H01Q 1/20 343/781 R |
| 3,739,538 | A | 6/1973 | Rubin | |
| 3,836,979 | A | 9/1974 | Kurland et al. | |
| 3,913,109 | A | 10/1975 | Owen | |
| 3,981,500 | A | 9/1976 | Ryan | |
| 4,527,166 | A | 7/1985 | Luly | |
| 4,683,475 | A | 7/1987 | Luly | |
| 4,771,293 | A | 9/1988 | Williams et al. | |
| 5,150,556 | A | 9/1992 | Yamada et al. | |
| 5,351,060 | A | 9/1994 | Bayne | |
| 5,485,168 | A | 1/1996 | Parekh | |
| 5,531,567 | A | 7/1996 | Hulls | |
| 5,721,558 | A | 2/1998 | Holemans | |
| 6,366,252 | B1 | 4/2002 | Terk | |
| 6,366,255 | B1 | 4/2002 | Chiang | |
| 7,612,735 | B2 | 11/2009 | Essig, Jr. et al. | |
| 8,816,187 | B1 | 8/2014 | Stribling et al. | |

(Continued)

*Primary Examiner* — Hoang V Nguyen

(74) *Attorney, Agent, or Firm* — Fox Rothschild LLP; Robert J. Sacco; Carol E. Thorstad-Forsyth

(57) ABSTRACT

Reflecting systems, such as reflector antenna systems, can include a first and a second reflector, and a sub-reflector positioning apparatus. The sub-reflector positioning apparatus has a tensioner attached to the second reflector and configured to exert a force on the second reflector. The force urges the second reflector away from the first reflector. The sub-reflector positioning apparatus also includes a plurality of restraints attached to the first and second reflectors. The restraints are configured to be tensioned in response to the force on the second reflector, and to restrain the second reflector at a pre-determined position in relation to the first reflector.

19 Claims, 9 Drawing Sheets

(56) References Cited

U.S. PATENT DOCUMENTS

| | | | | |
|---|---|---|---|---|
| 9,608,333 | B1 | 3/2017 | Toledo et al. | |
| 2004/0194397 | A1 | 10/2004 | Brown et al. | |
| 2007/0200789 | A1 | 8/2007 | Bassily | |
| 2018/0048059 | A1* | 2/2018 | Greschik | H01Q 1/08 |

* cited by examiner

REFLECTING SYSTEMS, SUCH AS REFLECTOR ANTENNA SYSTEMS, WITH TENSION-STABILIZED REFLECTOR POSITIONING APPARATUS

BACKGROUND

Statement of the Technical Field

This document relates to antenna reflector systems and other types of systems and structures having a first component, such as a primary reflector, and a second component, such as a sub-reflector, that is spaced apart from the first component in predetermined positional relationship.

Description of the Related Art

Reflector antenna systems are used on satellites and other systems that communicate using radio-frequency (RF) energy and other types of electromagnetic energy. Reflector antenna systems focus the RF energy that is being received or transmitted by the satellite. A reflector antenna system can include a primary reflector having a parabolic shape; a radio frequency (RF) feed positioned proximate the center, or hub of the primary reflector; and a sub-reflector spaced apart from, and facing the primary reflector and the feed.

When the satellite is receiving RF energy from an external transmitting source, the primary reflector focuses and reflects the RF energy on the sub-reflector. The sub-reflector further focuses the RF energy and reflects the energy onto the feed in a folded optics configuration. The feed converts the RF energy into an electrical signal, and transmits the signal to a transceiver of the satellite. When the satellite is transmitting, the feed converts an electrical signal from the transceiver into RF energy, and directs the RF energy onto the sub-reflector. The sub-reflector focuses and reflects the RF energy onto the primary reflector. The primary reflector further focuses and reflects the RF energy away from the satellite and toward an external receiving source. In order to optimally focus and reflect the RF energy between the primary reflector and the feed, the sub-reflector needs to be precisely located at a predetermined position in relation to the primary reflector and the feed.

The space available to accommodate a reflector antenna system of a satellite during launch and transit to orbit typically is very limited. The primary reflector of a typical reflector antenna system needs a relatively large reflecting surface to adequately focus the RF energy being transmitted and received. The large surface area of the primary reflector usually necessitates folding of the antenna system into a relatively compact stowed configuration. This be achieved, for example, by forming the reflecting surface of the primary reflector from a foldable material that is supported by a rigid frame; and configuring the frame to fold inwardly to reduce the overall diameter of the antenna system. Further reductions in the stowed volume can be achieved by configuring each individual arm, or rib of the frame to include two or more sections that hinge, or fold in relation to each other, so as to reduce the overall stowed height of the antenna system.

In addition, compact stowage of a reflector antenna system usually requires that the sub-reflector be moved to a position proximate the feed and the hub. This previously has been achieved, for example, by mounting the sub-reflector on rigid struts that are retracted below the hub, and remain in that position until the antenna is ready to be deployed. The struts are biased upward, toward the raised, or deployed position of the sub-reflector, by springs. The struts are retained in their retracted position by a locking mechanism. When the sub-reflector is to be deployed, the struts are released, and the sub-reflector moves to its deployed position above the feed and the hub of the primary reflector in response to the bias of the springs.

Mechanisms for stowing the sub-reflector typically add weight and complexity to an antenna system. Also, the rigid struts typically used to support the sub-reflector can partially block, and thereby impair, the RF energy being transmitted and received by the antenna system.

SUMMARY

This document concerns reflector antenna systems, and other mechanical assemblies where two or more components must be deployed to predetermined relative positions. The antenna systems can include a reflector, a feed, and a sub-reflector configured to reflect energy between the reflector and the feed. The systems also include a sub-reflector positioning apparatus. The sub-reflector positioning apparatus has a tensioner attached to the sub-reflector and configured to exert a force on the sub-reflector. The force urges the sub-reflector away from the reflector. The sub-reflector positioning apparatus also includes a plurality of restraints attached to the sub-reflector. The restraints are configured to be tensioned in response to the force on the sub-reflector, and to restrain the sub-reflector in relation to the reflector.

This document also relates to reflector systems. The systems can include a first reflector, a second reflector, and a plurality of collapsible restraints each being attached to the first and second reflectors. The restraints are configured so that the restraints, when under tension and fully extended, locate the first reflector at a first predetermined position in relation to the second reflector.

This document further relates to other mechanical systems where two or more components must be deployed to predetermined relative positions. Such systems can include a first member, a second member adjacent to the first member and being located in a predetermined position in relation to the first member, and a support apparatus. The support apparatus has a tensioner in the form of an elongated beam that is attached to the first and second members, and is configured to exert a force on the second member when the elongated beam resiliently deflects. The force urges the second member away from the first member. The support apparatus also has six restraints each being attached to the first and the second members and positioned in the form of a hexapod. The restraints are configured to be tensioned in response to the force on the second member, and to locate the second member in the pre-determined position when tensioned.

BRIEF DESCRIPTION OF THE DRAWINGS

This disclosure is facilitated by reference to the following drawing figures, in which like numerals represent like items throughout the figures, and in which.

DETAILED DESCRIPTION

Figure 1:
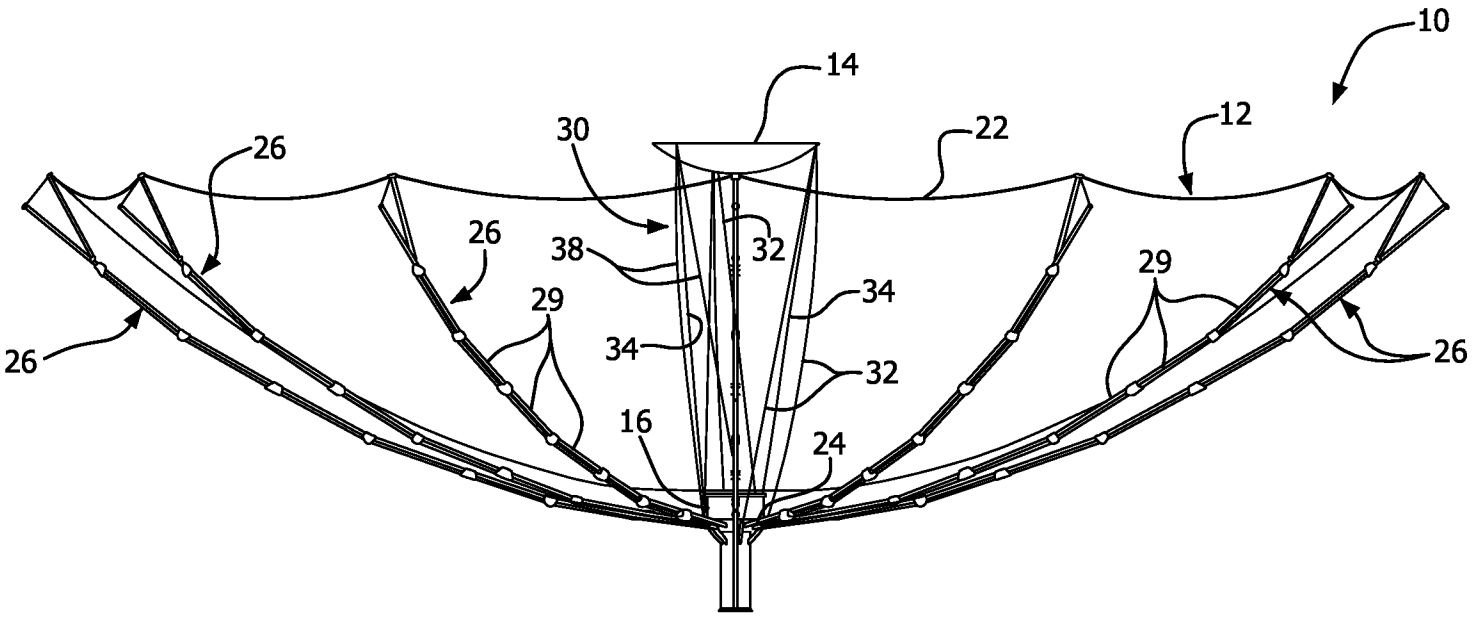
FIG. 1 is a side view of a reflector antenna system with a tension-stabilized sub-reflector positioning apparatus, with a web of the antenna system shown as translucent for the purpose of illustrating the sub-reflector positioning apparatus; with a reflector and a sub-reflector of the antenna system in their deployed positions, and the sub-reflector positioning apparatus in its deployed configuration.

It will be readily understood that the components of the systems and/or methods as generally described herein and illustrated in the appended figures could be arranged and designed in a wide variety of different configurations. Thus, the following more detailed description, as represented in the figures, is not intended to limit the scope of the present disclosure, but is merely representative of certain implementations in various different scenarios. While the various aspects are presented in the drawings, the drawings are not necessarily drawn to scale unless specifically indicated.

The figures depict a reflecting system in the form of a reflector antenna system 10 for use in a satellite. The reflector antenna system 10 can both receive and transmit RF energy. In particular, the antenna system 10 receives and focuses RF energy, converts the focused RF energy into an electrical signal, and sends the signal to a transceiver of the satellite. The antenna system 10 also converts electrical signals from the transceiver into RF energy, and focuses and transmits the RF energy.

Specific details of the reflector antenna system 10 are provided for exemplary purposes only. The inventive concepts disclosed herein can be applied to other types of antenna systems and other types of reflecting systems, including antenna systems used in applications other than satellites and other zero-gravity applications; antenna systems that only transmit or only receive RF energy; antenna systems that receive and/or transmit energy other than RF energy; and antenna systems with a dish-type reflector that does not fold or otherwise assume a relatively compact stowed configuration. Also, the inventive concepts can be applied to other types of devices requiring precise relative positioning of two or more components spaced apart by a predetermined distance, including but not limited to reflecting systems that receive and focus sunlight and other visible light.

Figure 2:
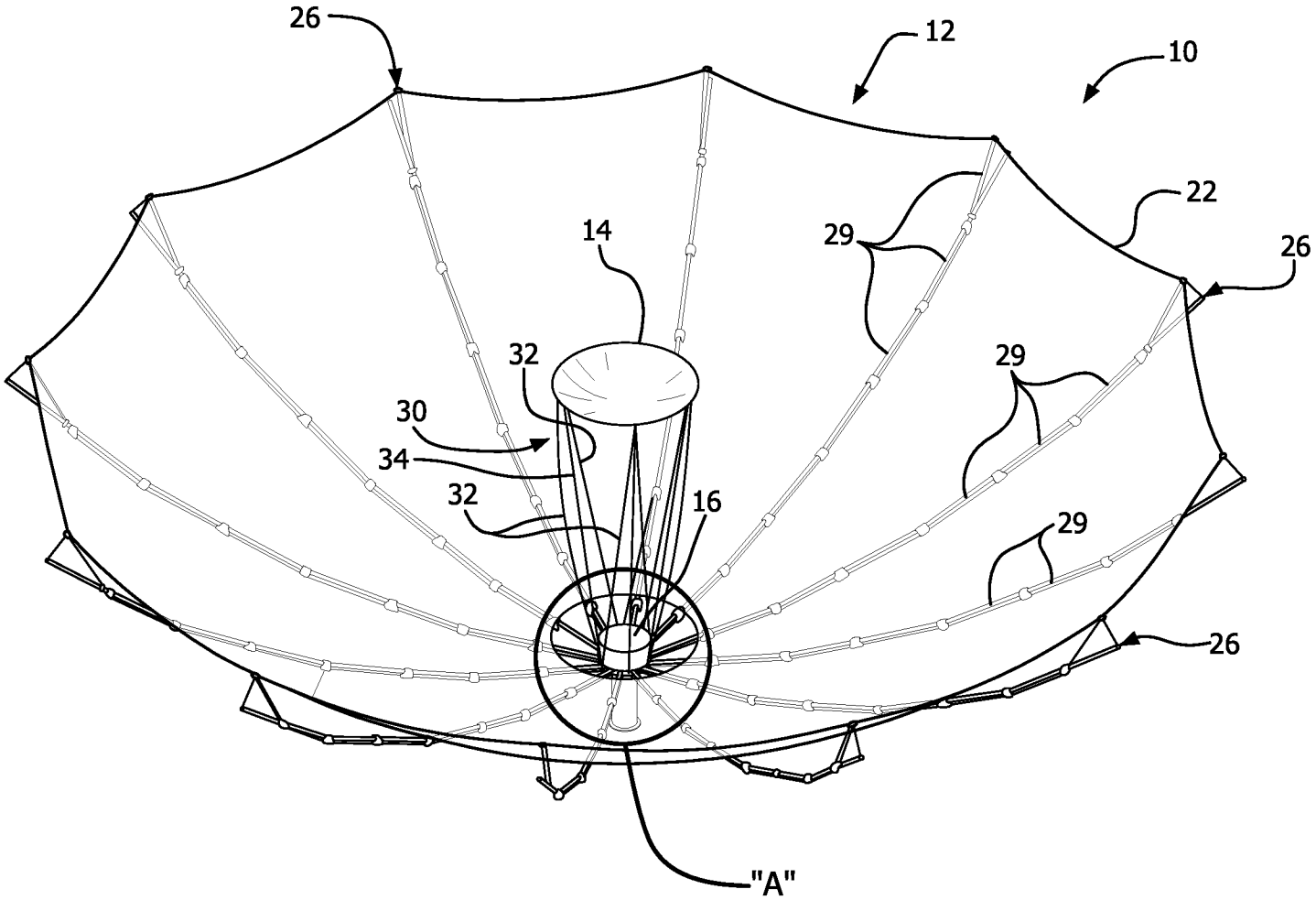
FIG. 2 is a top perspective view of the antenna system shown in FIG. 1, with the reflector and sub-reflector in their deployed positions, and the sub-reflector positioning apparatus in its deployed configuration.
Figure 5:
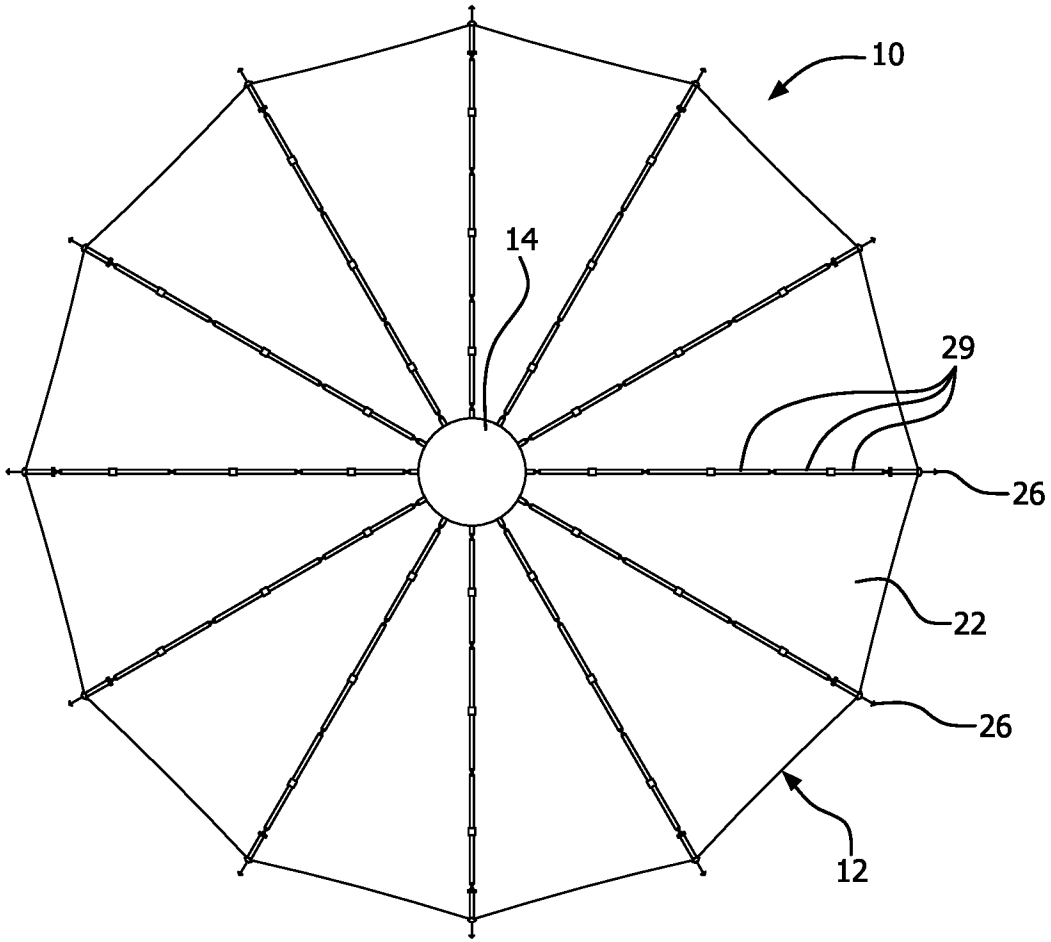
FIG. 5 is a top view of the antenna system shown in FIGS. 1-4, with the reflector and sub-reflector in their deployed positions, and the sub-reflector positioning apparatus in its deployed configuration.

The reflector antenna system 10 includes a primary reflector 12, a sub-reflector 14, and a feed 16. The primary reflector 12 comprises a centrally-located hub 24, a plurality of ribs 26 pivotally coupled to the hub 24, and an RF-reflective fabric 22. The fabric 22 can be formed from a foldable material that, when unfolded as shown in FIGS. 1, 2, and 5, forms a surface that reflects RF energy. The ribs 26 provide structural support to the flexible fabric 22.

Figure 3:
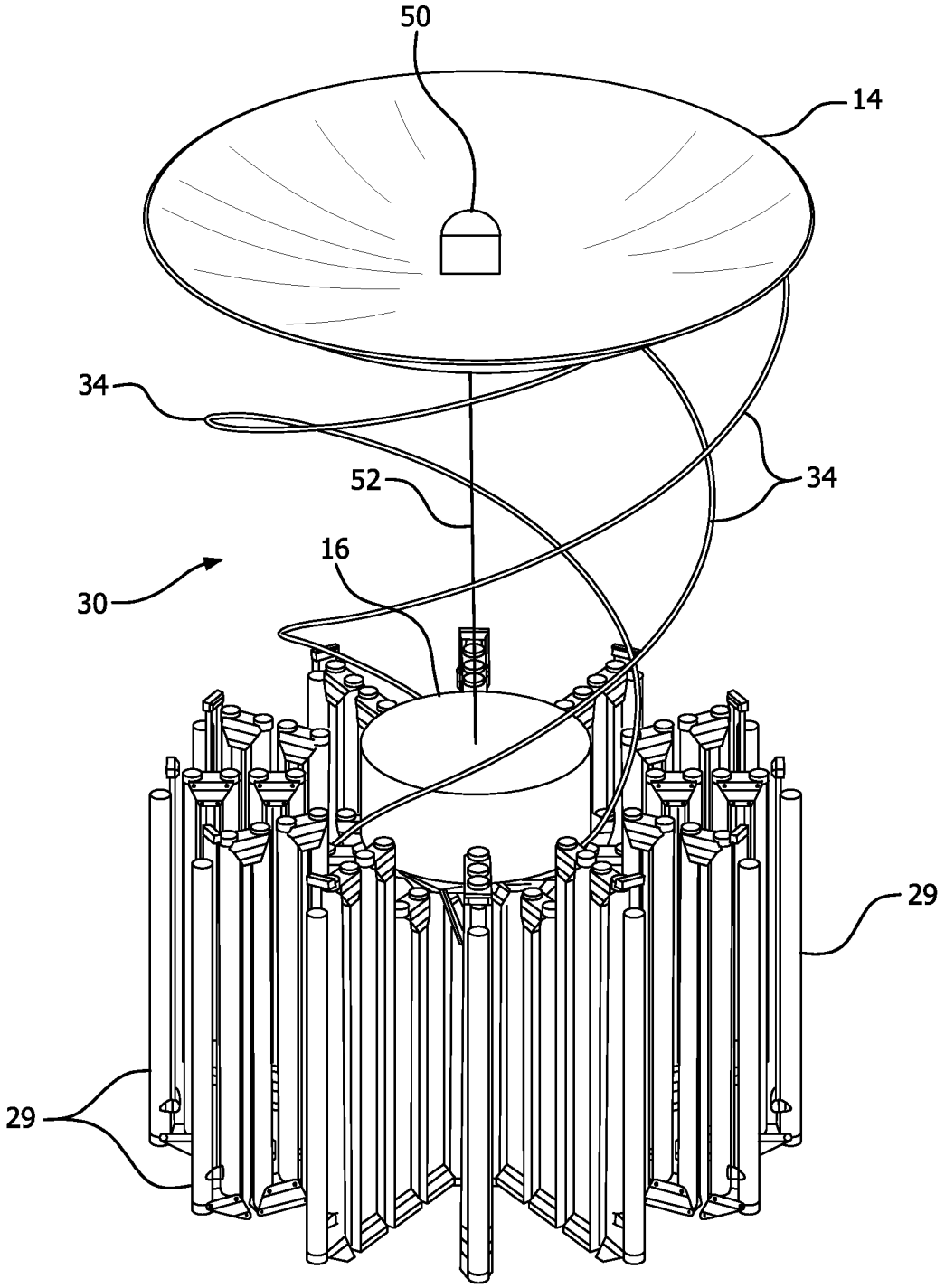
FIG. 3 is a top perspective view of the antenna system shown in FIGS. 1 and 2, with the reflector in its stowed position, the sub-reflector moving between its stowed and deployed positions, and the sub-reflector positioning apparatus moving between its stowed and deployed configurations.
Figure 6:
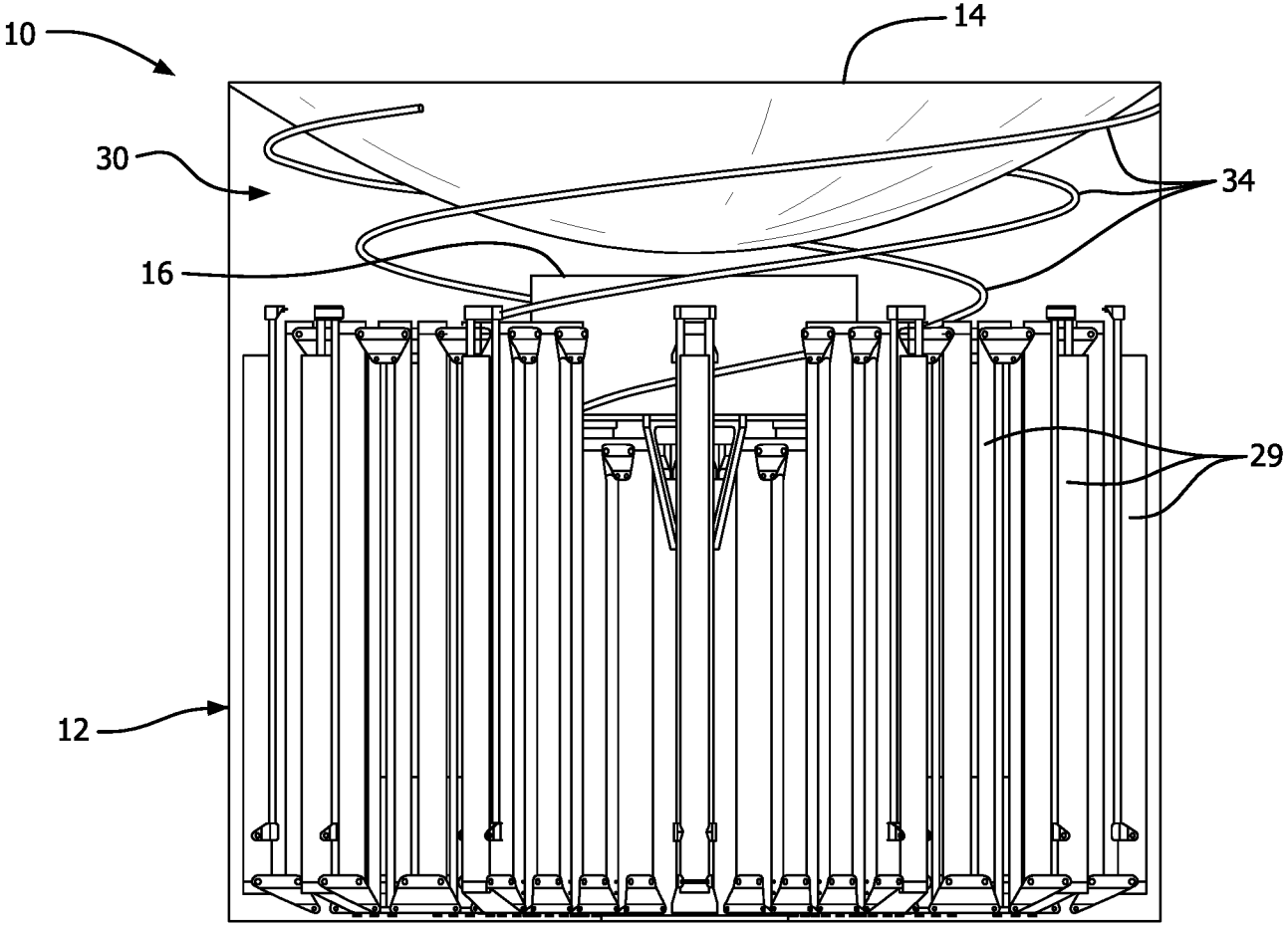
FIG. 6 is a side view of the antenna system shown in FIGS. 1-5, with the reflector and sub-reflector in their stowed positions, and the sub-reflector positioning apparatus in its stowed configuration.
Figure 7:
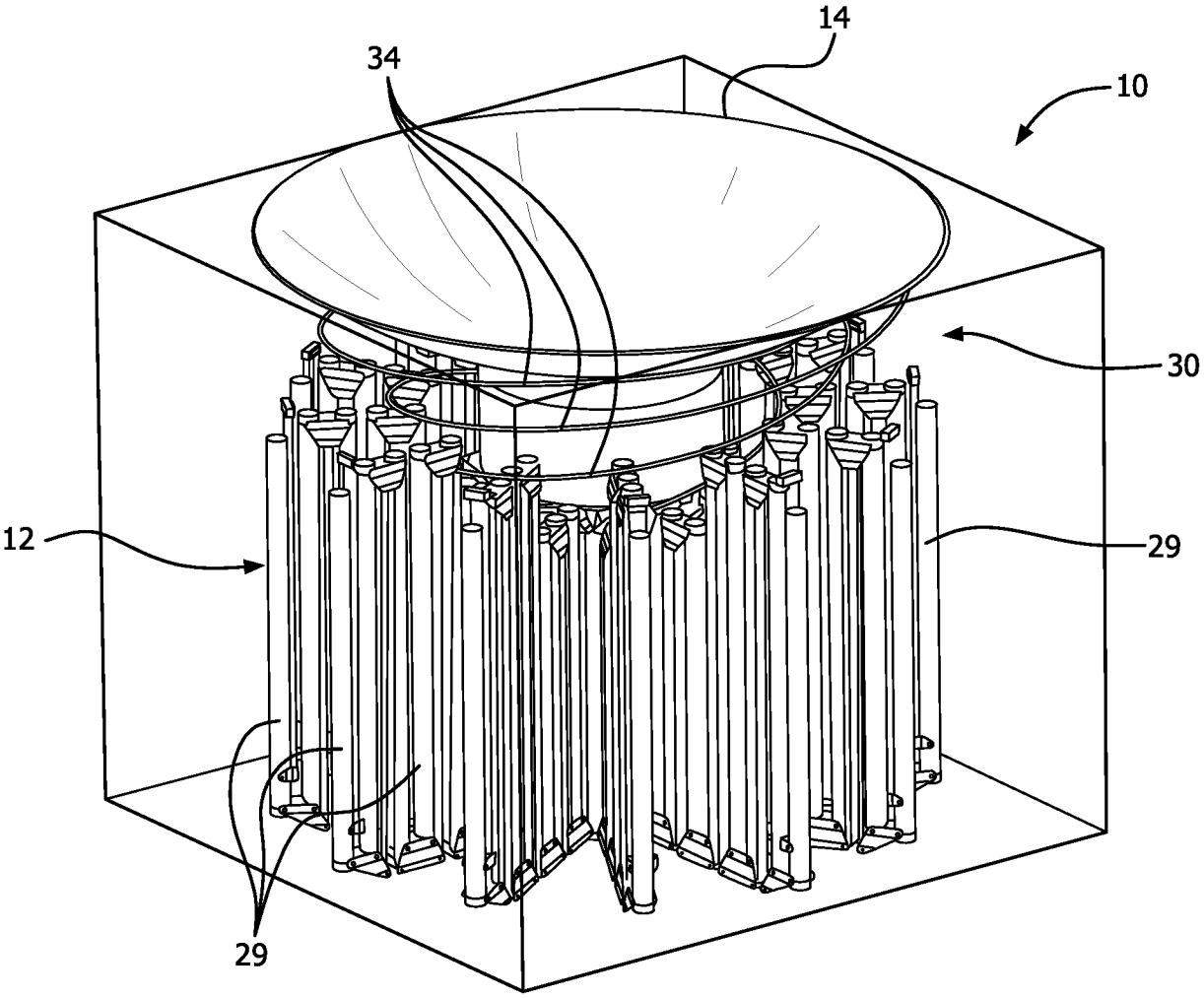
FIG. 7 is a top perspective view of the antenna system shown in FIGS. 1-6, with the reflector and sub-reflector in their stowed positions, and the sub-reflector positioning apparatus in its stowed configuration.

Each rib 26 comprises multiple rib tubes 29 connected via common hinge points. The innermost rib tube 29 is connected to the hub 24 by way of an additional hinge point that, in conjunction with the common hinge points, permit the ribs 26, and the attached fabric 22, to be folded into a compact configuration as depicted in FIGS. 3, 6, and 7, thereby facilitating storage of the reflector antenna system 10 within a relatively small volume.

The fabric 22 can be unfolded into a deployed configuration as shown in FIGS. 1, 2, 4, and 5. When in the deployed state, the ribs 26 form a rigid framework that causes the fabric 22 to assume a parabolic shape. Due to its parabolic shape and reflective characteristics, the fabric 22 reflects and focuses RF energy incident thereupon.

The feed 16 is positioned at the center of the primary reflector 12, as can be seen in FIGS. 1 and 2. The sub-reflector 14 is shaped for folded optics and is not limited to either hyperbolic or parabolic shapes. The sub-reflector 14 is positioned directly above the feed 16, from the perspective of FIGS. 1 and 2, so that the convex side of the sub-reflector 14, in this example of a Cassegrain folded optic system, faces the feed 16.

When the reflector antenna system 10 is receiving RF energy from an external transmitting source, the primary reflector 12 receives the RF energy, and focuses and reflects the RF energy onto the sub-reflector 14. The sub-reflector 14 further focuses and reflects the RF energy onto the feed 16, which converts the RF energy into an electrical signal and transmits the signal to the transceiver of the satellite.

When the reflector antenna system 10 is transmitting RF energy to an external receiving source, the feed 16 converts an electrical signal from the transceiver into RF energy, and transmits the RF energy onto the sub-reflector 14. The sub-reflector 14 focuses and reflects the RF energy onto the primary reflector 12. The primary reflector 12 further focuses and reflects the RF energy toward an external receiving source.

The reflector antenna system 10 further comprises a tension-stabilized sub-reflector positioning apparatus 30. The positioning apparatus 30 is configurable in a stowed configuration shown in FIGS. 6 and 7, and a deployed configuration shown in FIGS. 1, 2, 4, and 5. The positioning apparatus 30, when in its deployed configuration, supports the sub-reflector 14, and positions the sub-reflector 14 at a predetermined position in relation to the primary reflector 12.

The positioning apparatus 30 comprises six restraints 32, and three tensioners in the form of tensioning members 34. The restraints 32 can be cables or cords capable of bearing tensile loads, and which collapse, i.e., buckle, in the absence of tensile loading.

The tensioning members 34 are configured so that the tensioning members 34 resiliently deflect when the positioning apparatus 30 is in its deployed configuration. The resilient deflection of the tensioning members 34 places the restraints 32 in tension, which in turn maintains the sub-reflector 14 in a predetermined position in relation to the primary reflector 12 and the feed 16. In addition, the tensioning members 34 can further deflect as shown in FIGS. 3, 6, and 7, so that the positioning apparatus 30 can assume its relatively compact stowed configuration in which the sub-reflector 14 is positioned proximate the feed 16.

As can be seen in FIGS. 1 and 2, the upper ends of the restraints 32 and the tensioning members 34 are attached to the sub-reflector 14, proximate the outer edge of the sub-reflector 14. The lower ends of the restraints 32 and the tensioning members 34 are attached to a bracket 40 of the system 10 as shown, for example, in FIG. 4. The bracket 40 is securely attached to the hub 24. The lower ends of the restraints 32 and the tensioning members 34, therefore, are indirectly attached to the primary reflector 12, by way of the bracket 40. The term "attached," as used herein and unless otherwise noted, is intended to encompass the direct attachment of two or more components to each other, as well as indirect attachment through one or more intermediate members.

The lower ends of the restraints 32 and the tensioning members 34 can be attached directly to the ribs 26 in alternative embodiments. In antenna systems having a reflector in the form of a solid, non-foldable dish, the lower ends of the restraints 32 and the tensioning members 34 can be attached directly to the dish.

The respective upper and lower ends of the restraints 32 can be attached to the sub-reflector 14 and the bracket 40 using any suitable means, such as brackets, clips, anchors, adhesive, etc., that secures the restraints 32 to the sub-reflector 14 and the bracket 40, and permits little or no relative movement between the ends of the restraint 32 and the adjacent sub-reflector 14 or bracket 40 in the lengthwise direction of the restraint 32.

The respective upper and lower ends of the tensioning members 34 can be attached to the sub-reflector 14 and the bracket 40, or alternate attachment locations, using a suitable means, such as ball joints, swivels, rotational end fittings, etc., that secures the tensioning members 34 to the sub-reflector 14 and the bracket 40, and permits little or no relative movement between the ends the tensioning members 34 and the adjacent sub-reflector 14 or bracket 40 in the lengthwise direction of the tensioning members 34; while permitting relative rotation between the tensioning members 34, and the sub-reflector 14 and bracket 40, i.e., the attachment means allows the tensioning members 34 to twist in relation to the sub-reflector 14 and the bracket 40. As explained below, the relative rotation, or twisting, between the tensioning members 34 and the sub-reflector 14 and bracket 40 is necessary to allow the tensioning members 34 to properly move from their stowed configuration shown in FIGS. 6 and 7, to their deployed positions shown in FIGS. 1, 2, 4, and 5.

The restraints 32 are arranged in the form of a hexapod. In particular, the upper end of each restraint 32 is attached the sub-reflector 14 at a common point with one of its adjacent, i.e., neighboring, restraints 32, as can be seen in FIG. 1. The lower end of the restraint 32 is attached to the bracket 40 at a common point with its other adjacent restraint 32, as can be seen FIGS. 1 and 4. Thus, each restraint 32 meets one of its neighboring restraints 32 at its upper end, and meets its other neighboring restraint 32 at its lower end. This arrangement results in a total of three attachment points between the restraints 32 and the sub-reflector 14, and three attachment points between the restraints 32 and the bracket 40. The attachment points for the neighboring restraints 32 can be at proximate, as opposed to common, locations on the sub-reflector 14 and the bracket 40 in alternative embodiments.

The three attachment points between the restraints 32 and the sub-reflector 14 are angularly spaced around the periphery of the sub-reflector 14 by approximately 120 degrees, from the perspective of FIG. 5. The three attachment points between the restraints 32 and the bracket 40 likewise are angularly spaced around the periphery of the bracket 40 by approximately 120 degrees. Also, the attachment points on the sub-reflector 14 are angularly offset from the attachment points on the bracket 40 by approximately 60 degrees, as viewed from the perspective of FIG. 5.

Figure 4:
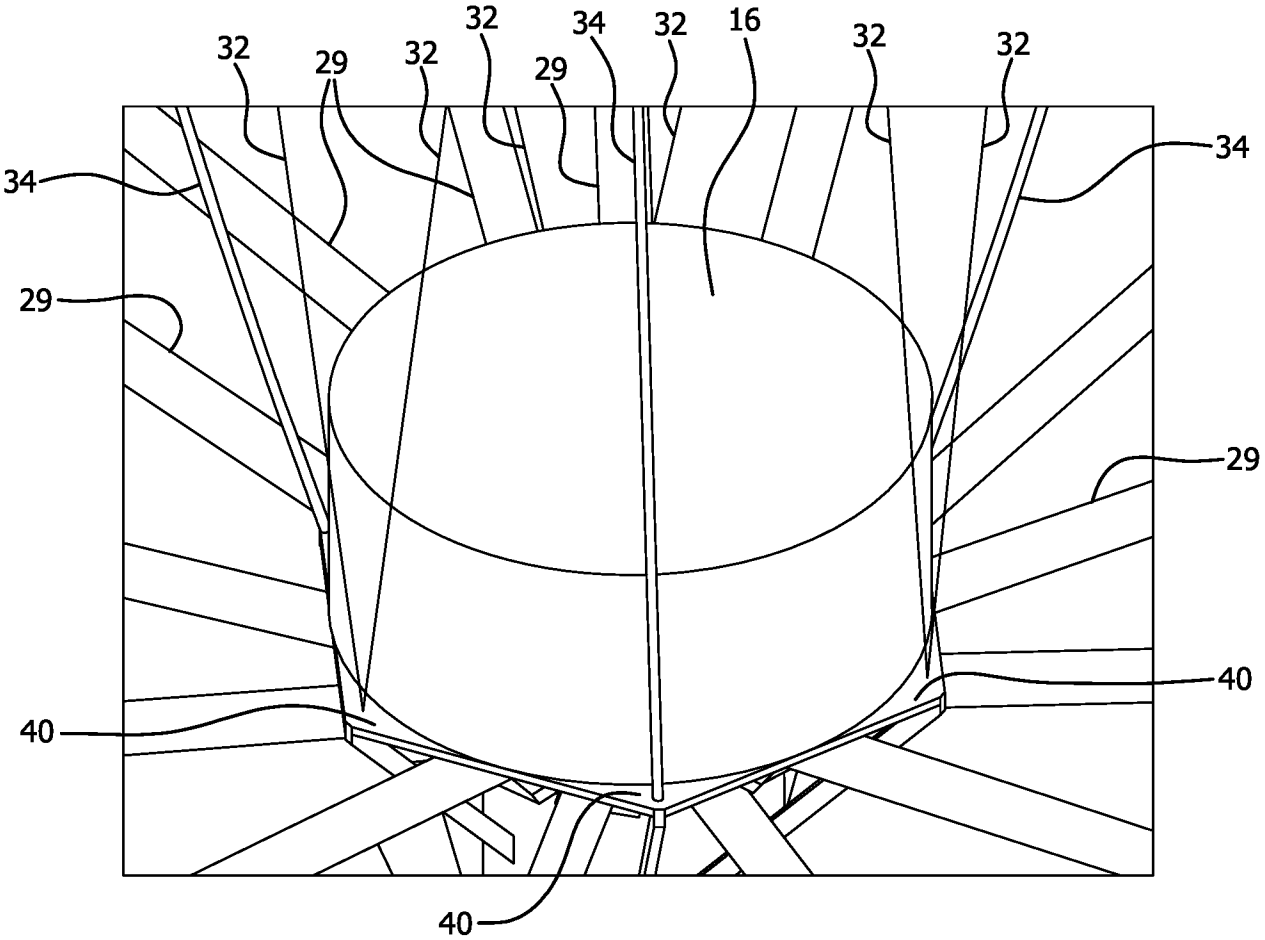
FIG. 4 is a magnified view of the area designated "A" in FIG. 2.

Each of the tensioning members 34 is associated with two of the restraints 32, as can be seen in FIGS. 1, 2, and 4. A first, or upper end of each of the tensioning members 34 is attached to the sub-reflector 14 proximate the common attachment point for the two restraints 32 associated with that particular tensioning member 34. The attachment point between the second, or lower end of each tensioning member 34 and the bracket 40 is at the same angular or clock position, from the perspective of FIG. 5, as the attachment point of the upper end of the tensioning member 34. Due to this arrangement, the attachment point of the lower end of the tensioning member 34 to the bracket 40 is approximately equidistant from the attachment points between its associated restraints 32 and the bracket 40.

The tensioning members 34 are configured to resiliently deflect when the positioning apparatus 30 is in its deployed position, and the resilient deflection of the tensioning members 34 places the restraints 32 in tension. In particular, the length of the restraints 32 is selected so that the sub-reflector 14 is located at a desired position in relation to the primary reflector 12 and the feed 16 when the restraints 32 are fully extended as depicted in FIGS. 1, 2, and 4. The length of the tensioning members 34, in turn, is selected so that the tensioning members 34 cannot fully extend, and thus remain partially deflected, when the restraints 32 are fully extended. The resilience of the tensioning members 34 causes the tensioning members 34 to generate a spring force when deflected in this manner, which in turn causes the tensioning members 34 to exert an upwardly-directed reactive force on the sub-reflector 14, This force is transmitted to the restraints 32 by way of the rigid sub-reflector 14, and urges the restraints 32 upward so as to maintain tension in the restraints 32. Because the tension in the restraints 32 causes each restraint 32 to extend to its maximum length, and the restraints 32 restrain the sub-reflector 14 at three locations on the sub-reflector 14, the tensioned restraints 32 maintain, or stabilize, the sub-reflector 14 in a precise, pre-determined position in relation to the primary reflector 12 and the feed 16.

The requisite or desired tension in the restraints 32 is application dependent, and can vary with factors such as the allowable or desired degree of relative movement between the sub-reflector 14 and the primary reflector 12 and feed 16; the magnitude of any external forces, e.g., maneuvering loads or gravitational forces, to which the sub-reflector 14 will be subjected when deployed; the mechanical properties, e.g., modulus of elasticity and coefficient of thermal expansion, of the material from which the restraints 32 are formed; the range of temperatures to which the restraints 32 will be exposed, etc.

The restraints 32 and the tensioning members 34 each have a substantially circular cross section. The restraints 32 and the tensioning members 34 can have other types of cross sections in the alternative.

The restraints 32 can be formed from a material that is relatively stiff, i.e., having a relatively high modulus of elasticity; and that has a relatively low coefficient of thermal expansion. These characteristics can help minimize the deflection, or change in length, of the restraints 32 in response to the mechanical loads on the restraint 32, and changes in temperature. Minimizing the change in length of the restraints 32 allows the positioning apparatus 30 to maintain the sub-reflector 14 at a precise location in relation to the primary reflector 12 and the feed 16 on a consistent and repeatable basis. Also, the material needs to have sufficient flexibility to permit the restraints 32 to easily bend, fold, and collapse when not under tension, to facilitate movement of the positioning apparatus 30 between its deployed and stowed configurations. The restraints 32 can be formed, for example, from quartz, graphite, or Kevlar®. Other types of materials can be use in the alternative, based on considerations such as the temperature range and mechanical loading to which the restraints 32 will be subjected; the degree of precision with which the sub-reflector 14 needs to positioned; cost; etc.

The tensioning members 34 can be formed from any suitable material that provides the tensioning members 34 with the ability to resiliently deflect or bend, as shown in FIGS. 3, 6, and 7, when subjected to a lateral bending load or compressive loading along its lengthwise axis. For example, the tensioning members 32 can be formed from fiberglass, graphite, or carbon fiber. The requisite or desired degree of tension in the restraints 32 can be achieved by selecting an appropriate combination of material type, length, and cross-sectional area for the tensioning members 34.

The restraints 32, as discussed above, have sufficient flexibility to permit the restraints 32 to fold, bend, and collapse when the restraints 32 are not under tension. The ability of the restraints 32 to fold, bend, and collapse permits the restraints 32 to assume a relatively compact footprint that facilitates storage between the sub-reflector 14 and the primary reflector 12, when the sub-reflector 14 is in its stowed position proximate the primary reflector 12.

The required resilience of the tensioning members 34 prevents them from collapsing in a manner similar to the restraints 32 when the positioning apparatus 30 is in its stowed configuration. Instead, the tensioning members 34 are bent as shown in FIGS. 6 and 7, so that the tensioning members 34 assume a spiral configuration centered about the feed 16. This feature permits the sub-reflector 14 to be lowered in relation to the primary reflector 12 and the feed 16, without bending the tensioning members 34 to an extent sufficient to cause permanent deformation or breakage of the tensioning members 34.

The resilience of the tensioning members 34 causes the tensioning members 34 to exert an upwardly-acting spring force on the sub-reflector 14 when the positioning apparatus 30 is in its stowed configuration. The sub-reflector 14, or the tensioning members 34 themselves, can be restrained from upward movement by a suitable means (not shown) such as latches, cables, ties, retractable or foldable arms, etc., to maintain the sub-reflector 14 in its stowed position.

The antenna system 10 has a relatively compact configuration when the primary reflector 12 and sub-reflector 14 are in their stowed positions, as shown in FIGS. 6 and 7. The antenna system 10 can be configured in this manner during launch of the satellite on which the system 10 is installed. The primary reflector 12 and the sub-reflector 14 can be moved to their deployed positions when the satellite has been inserted into orbit and is otherwise ready to begin normal operations. The primary reflector 12 can be configured in its deployed position using a mechanism (not shown) that moves the ribs 26 to the unfolded state, which in turn unfolds the fabric 22 and causes the fabric 22 to assume its parabolic shape, as shown in FIGS. 1, 2, and 5. The primary reflector 12 can be deployed before, during, or after the sub-reflector 14 is moved to its deployed position.

The sub-reflector 14 can be deployed by removing the restraining means that prevents the tensioning members 34 from moving to their deployed positions. Upon removal of the restraining means, the resilience of the highly-deflected tensioning members 34 causes the tensioning members 34 to move toward their less deflected, deployed position shown FIGS. 1, 2, and 4. This movement of the tensioning members 34 draws the restraints 32 from their collapsed state, and into tension. Although not used in the positioning apparatus 30, known cord-management techniques can be applied to the restraints 32 in alternative embodiments, to help minimize the potential for the restraints 32 to tangle as they deploy. Also, the above-noted ability of the tensioning members 34 to rotate in relation to the primary reflector 12 and the sub-reflector 14 permits the tensioning members 34 to move from the highly-deflected spiral arrangement shown in FIGS. 6 and 7 to their less-deflected deployed orientation shown in FIGS. 1, 2, and 4, without subjecting the tensioning members 34 to excessive torsional loading.

The positioning apparatus 30 include a rotary damper 50 or other suitable means for slowing the movement of the sub-reflector 14 as it moves away from the primary reflector 12 in response to the force exerted by the tensioning members 34. The damper 50 is mounted on the sub-reflector 14 as depicted in FIG. 3, and is connected to the primary reflector 12 by a restraint cord 52 that unwinds from the damper 50 as the sub-reflector 14 moves away from the primary reflector 12. The damper 50 dampens the speed at which the restraining cord 52 unwinds, thereby slowing the movement of the sub-reflector 14 toward its deployed position. Alternative embodiments can be configured without the damper 50.

Once the restraints 32 are fully extended, thereby placing the sub-reflector 14 in its deployed position, the tensioning members 34 are inhibited from further movement toward their un-deflected state, and remain partially deflected as shown in FIG. 1. As explained above, the resilience of the partially-deflected tensioning members 34 maintains tension in the restraints 32, and the tensioned restraints 32 maintain the sub-reflector 14 in a desired, stabilized position in relation to the primary reflector 12 and the feed 16.

The configuration of the restraints 32 in a hexapod arrangement is described for exemplary purposes only. The restraints 32 can be configured in other arrangements that result in three or more points of restraint on the sub-reflector 14, including but not limited to arrangements in which the points of restraint are not equally spaced around the periphery of the sub-reflector 14, or in which some or all the points of restraint are located radially inward of the periphery of the sub-reflector 14.

Figure 8:
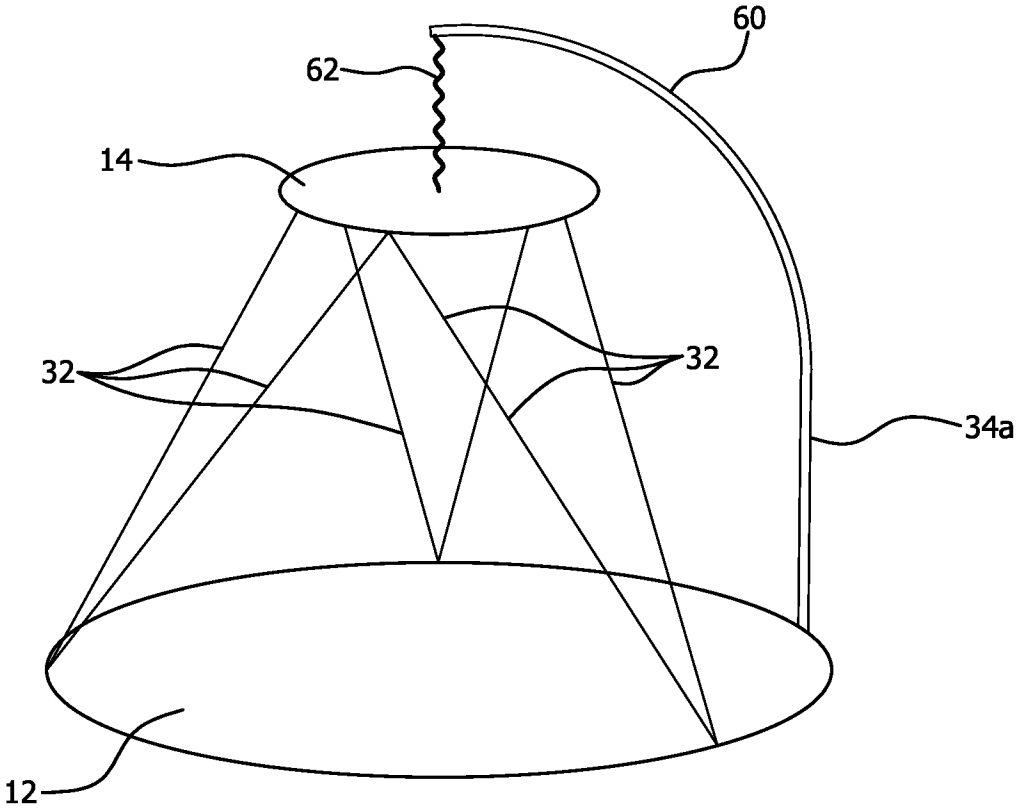
FIG. 8 is a top perspective view of a reflector antenna system having an alternative embodiment of the sub-reflector positioning apparatus shown in FIGS. 1-7.

Also, alternative embodiments can use less, or more than three tensioning members 34; and tensioners other than elongated, resilient members such as the tensioning members 34. For example, alternative embodiments can include a single tensioning member **34*a* as depicted in FIG. 8. The tensioning member 34*a* adjoins a first end of a curvilinear support arm 60. A second, freestanding end of the support arm 60 is positioned over the center of the sub-reflector 14. The support arm 60 is connected to the sub-reflector 14 by way of a connecting member 62. The support arm 60 can be connected directly to the sub-reflector 14 in alternative embodiments. The tensioning member 34***a* and the support arm 60, in combination, pull the sub-reflector 14 away from the primary reflector 12 with a net force that causes tension in the restraints 32. The support arm 60 can be rigid. Alternatively, the support arm 60 can be flexible, so that the support arm 60 resiliently deflects and thereby generates a spring force that supplements the force resulting from the resilient deflection of the tensioning member 34*a*.

The positioning apparatus 30 can be used in applications where stowage within a limited volume is not required. In such applications, the restraints 32, the tensioning members 34, and other components of the system 10 do not need to be configured to facilitate reconfiguration of the positioning apparatus 30 between stowed and deployed positions.

The positioning apparatus 30 is relatively low cost, compact, and lightweight, and does not require motors, linkages, or other devices to deploy, making the use of the positioning apparatus 30 particularly advantageous, for example, in miniaturized satellites and spacecraft such as CubeSat satellites and ESPA-class spacecraft. Also, the relatively small restraints 32 and tensioning members 34 produce minimal blockage of the RF energy being received and transmitted by the reflector antenna system 10, resulting in minimal, or no significant impairment of the transmissions to and from the antenna system 10.

Figure 10:
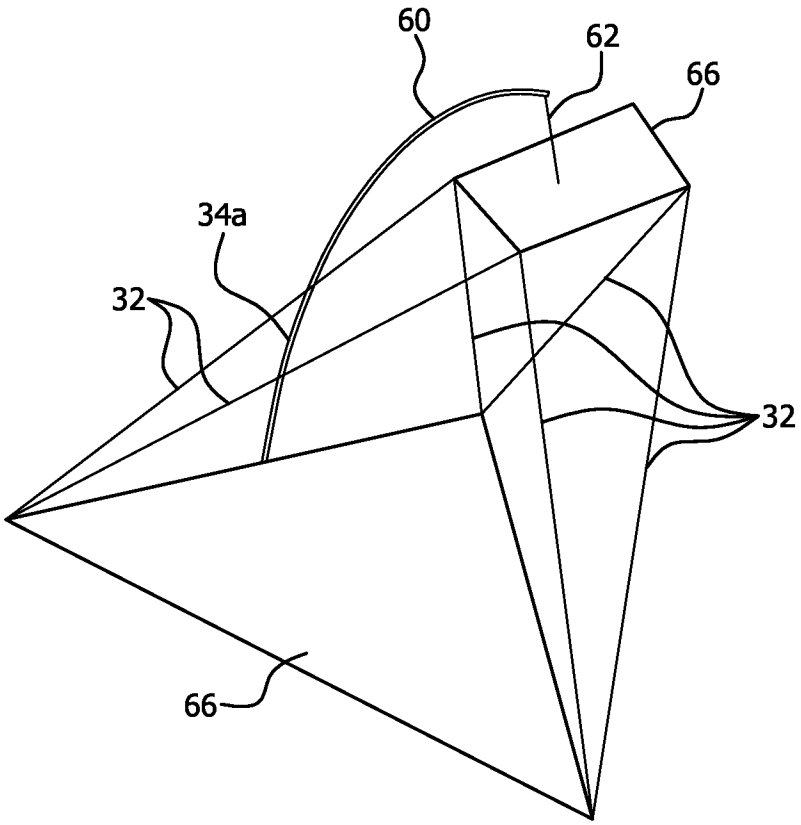
FIG. 10 is a perspective view of the sub-reflector positioning apparatus shown in FIG. 8 being used to position the objects shown in FIG. 9.
Figure 9:
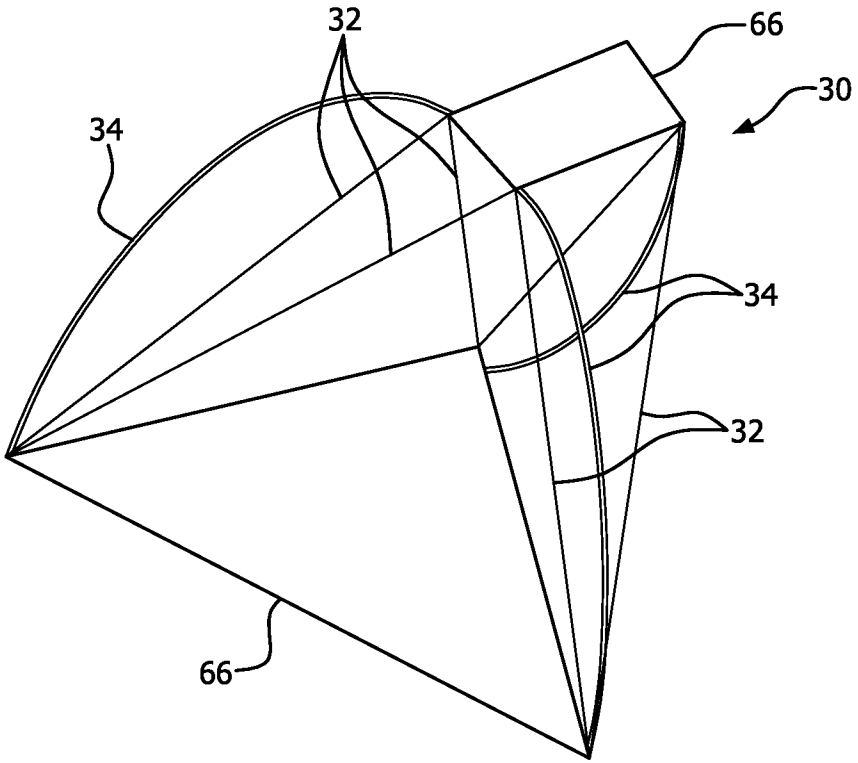
FIG. 9 is a top perspective view of the sub-reflector positioning apparatus shown in FIGS. 1-7 being applied to position two objects other than a sub-reflector and a primary reflector of a reflector antenna.

As noted above, the positioning apparatus 30, and alternative embodiments thereof, are not limited to use with reflector antenna systems, and can be applied to other types of devices requiring precise relative positioning of two or more components spaced apart by a predetermined distance. For example, FIG. 9 shows the positioning apparatus 30 being applied to position two objects 66 other than a primary reflector and a sub-reflector of a reflector antenna. As another example, FIG. 10 depicts the tensioning member 34*a* and support arm 60 being applied to position the objects 66.

We claim:

1. A reflector antenna system, comprising: a reflector; a feed; a sub-reflector configured to reflect energy between the reflector and the feed; and a sub-reflector positioning apparatus, the sub-reflector positioning apparatus comprising:

a tensioner attached to the sub-reflector and configured to exert a force on the sub-reflector, the force urging the sub-reflector away from the reflector; and a plurality of restraints attached to the sub-reflector and configured to be tensioned in response to the force on the sub-reflector, and to restrain the sub-reflector in relation to the reflector.

2. The system of claim 1, wherein the restraints are configured to restrain the sub-reflector at a predetermined position in relation to the reflector.

3. The system of claim 1, wherein the restraints and the tensioner are further attached to the reflector.

4. The system of claim 3, further comprising a bracket mounted on the reflector, wherein the restraints and the tensioner are attached to the reflector by way of the bracket.

5. The system of claim 1, wherein the sub-reflector positioning apparatus is configurable between a first configuration at which the sub-reflector is spaced apart from the reflector by a first distance; and a second configuration at which the sub-reflector is spaced apart from the reflector by a second distance; the second distance being less than the first distance.

6. The system of claim 5, wherein the sub-reflector positioning apparatus is further configured so that the restraints are fully extended and the tensioner is partially deflected when the sub-reflector is in the first position; and the restraints are collapsed and the tensioner is further deflected when the sub-reflector is in the second position.

7. The system of claim 1, wherein the tensioner is an elongated member configured to resiliently deflect when the restraints are fully extended, and the resilient deflection of the elongated member produces the force on the sub-reflector.

8. The system of claim 7, wherein:

the support apparatus comprises six of the restraints and three of the tensioners;

a first end of each the restraints and a first end of each of the tensioners is attached to the sub-reflector; and a second end of each the restraints and a second end of each of the tensioners is attached to the reflector.

9. The system of claim 8, wherein the restraints are positioned to form a hexapod.

10. A reflector system, comprising:

a feed;

a first reflector disposed on a first side of the feed;

a second reflector disposed on a second opposing side of the feed, having a reflecting surface facing the feed, and a diameter smaller than a diameter of the first reflector;

a tensioner;

a plurality of collapsible restraints; and a bracket disposed between the feed and the first reflector;

wherein the plurality of collapsible restraints are configured so that the plurality of collapsible restraints, when under tension by the tensioner and fully extended, locate the first reflector at a first predetermined position in relation to the second reflector; and wherein first end portions of the tensioner and the plurality of collapsible restraints are attached to the second reflector, and second end portions of the tensioner and the plurality of collapsible restraints are attached to the bracket.

11. The reflector system of claim 10, wherein the tensioner is configured to urge the first reflector away from the second reflector and thereby tension the restraints.

12. The reflector system of claim 11, wherein the tensioner is an elongated member configured to resiliently deflect when the plurality of collapsible restraints are fully extended, and the resilient deflection of the elongated member produces a force that urges the first reflector away from the second reflector and thereby tensions the plurality of restraints.

13. The reflector system of claim 12, further comprising six of the plurality of collapsible restraints and three of the tensioners.

14. The reflector system of claim 13, wherein the plurality of collapsible restraints are positioned to form a hexapod.

15. The reflector system of claim 10, wherein the first reflector has a reflecting surface that faces the reflecting surface of the second reflector.

16. A reflector system, comprising:

a feed;

a first reflector;

a second reflector; and a plurality of collapsible restraints each being attached to the first and second reflectors;

wherein the plurality of collapsible restraints are configured so that the plurality of collapsible restraints, when under tension and fully extended, locate the first reflector at a first predetermined position in relation to the second reflector wherein the first reflector has a reflecting surface, and the second reflector has a reflecting surface facing the reflecting surface of the first reflector; and wherein the reflecting surface of the second reflector faces the feed.

17. A reflector system, comprising:

a first reflector;

a second reflector;

a plurality of collapsible restraints each being attached to the first and second reflectors, the plurality of collapsible restraints being configured so that the plurality of collapsible restraints, when under tension and fully extended, locate the first reflector at a first predetermined position in relation to the second reflector;

a tensioner attached to the first and the second reflectors, the tensioner being configured to urge the first reflector away from the second reflector and thereby tension the restraints;

wherein the tensioner is an elongated member configured to resiliently deflect when the plurality of collapsible restraints are fully extended, and the resilient deflection of the elongated member produces a force on the first reflector that urges the first reflector away from the second reflector and thereby tensions the restraints;

wherein the plurality of collapsible restraints and the tensioner are configured so that the plurality of collapsible restraints are fully extended and the tensioner is partially deflected when the sub-reflector is in the first pre-determined position, and the plurality of collapsible restraints are collapsed and the tensioner is further deflected when the sub-reflector is in a second predetermined position proximate the first reflector.

18. A system comprising:

a feed;

a first reflector member disposed on a first side of the feed;

a second reflector member disposed on a second opposing side of the feed, having a reflective surface facing the feed, and being located in a predetermined position in relation to the first member;

a bracket disposed between the feed and the first reflector member; and a support apparatus comprising:

a tensioner comprising an elongated beam attached to the bracket and the second reflector member and configured to exert a force on the second reflector member when the elongated beam resiliently deflects, the force urging the second reflector member away from the first reflector member; and six restraints each being attached to the bracket and the second reflector member and positioned in the form of a hexapod, wherein the restraints are configured to be tensioned in response to the force on the second reflector member, and to locate the second reflector member in the pre-determined position when tensioned.

19. The system of claim 18, wherein the support apparatus is configurable between a first configuration at which the second reflector member is spaced apart from the first reflector member by a first distance, and a second configuration at which the second reflector member is spaced apart from the first reflector member by a second distance that is less than the first distance.

* * * * *